United States Patent [19]

Brudy

[11] 3,955,872

[45] May 11, 1976

[54] SHOCK RESISTANT LAMP SUPPORT

[75] Inventor: Peter E. Brudy, Willowdale, Canada

[73] Assignee: Dominion Auto Accessories Limited, Toronto, Canada

[22] Filed: Mar. 26, 1974

[21] Appl. No.: 454,914

Related U.S. Application Data

[63] Continuation-in-part of Ser. No. 348,120, April 5, 1973, abandoned.

[52] U.S. Cl. ..... 339/93 L; 339/132 R; 339/208

[51] Int. Cl.[2] ..... H01R 33/12

[58] Field of Search ..... 339/59 R, 59 L, 59 M, 339/93 R, 93 C, 93 L, 119 R, 119 L, 132 R, 132 B, 132 T, 206 R, 206 L, 207 R, 208; 248/358

[56] References Cited

UNITED STATES PATENTS

| | | | |
|---|---|---|---|
| 2,356,601 | 8/1944 | MacCarthy | 339/93 L X |
| 2,726,293 | 12/1955 | Bramming | 339/206 L X |
| 3,162,164 | 12/1964 | Eck | 248/358 A |
| 3,351,888 | 11/1967 | Ford | 339/132 R X |
| 3,386,070 | 5/1968 | Jansson et al. | 339/119 L X |
| 3,543,224 | 11/1970 | Fisher | 339/208 X |

*Primary Examiner*—Joseph H. McGlynn
*Assistant Examiner*—Howard N. Goldberg
*Attorney, Agent, or Firm*—Barnes, Kisselle, Raisch & Choate

[57] ABSTRACT

A shock resistant lamp support comprising a plastic lamp receiving socket having interengaging means thereon for receiving and holding a bulb in position, integral flexible portion extending from said socket portion, and having a sufficiently thin cross section to provide relative resiliency with respect to the socket, and an integral base portion having a relatively rigid cross section connected to said flexible portion.

17 Claims, 9 Drawing Figures

SHOCK RESISTANT LAMP SUPPORT

This application is a continuation-in-part of my application Ser. No. 348,120 filed Apr. 5, 1973, now abandoned.

This invention relates to lamp or bulb supports and particularly to shock resistant lamp supports.

BACKGROUND OF THE INVENTION

In the use of electric lamps or bulbs on automotive vehicles for clearance lights, taillights and the like, an important and serious problem is damage to the bulb caused by the vibrations and shocks incident to the movement of the automotive vehicle along the ground. It has heretofore been suggested that resilient mounts be provided in the form of rubber blocks, cushions and the like. However, such mounts are expensive to manufacture, require complex assembly procedures and usually must be designed for each environment.

Among the objects of the present invention are to provide a shock resistant lamp support which is low cost, simple, has a minimum number of parts, and is easily assembled and mounted.

SUMMARY OF THE INVENTION

The shock resistant lamp support embodying the invention comprises a plastic lamp receiving socket having interengaging means thereon for receiving and holding a bulb in position, integral flexible portions extending from said socket portion, and having a sufficiently thin cross section to provide relative resiliency with respect to the socket, and an integral base portion having a relatively rigid cross section connected to said flexible portion.

DESCRIPTION

Figure 1:
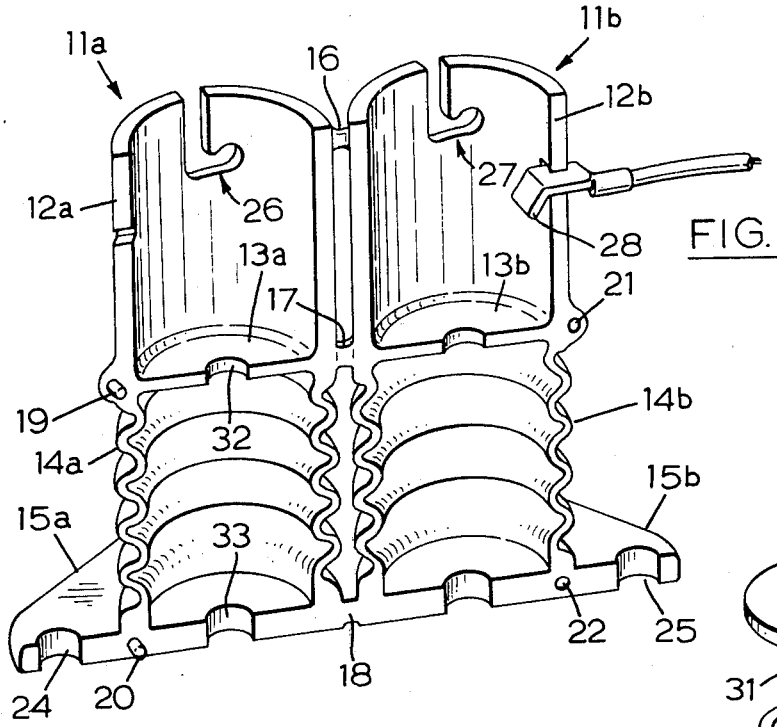
FIG. 1 is a perspective view of a lamp support embodying the invention before assembly.

Referring to the drawings, the lamp support embodying the invention is made preferably by injection molding in a single piece from a plastic material such as low density linear polyethylene. As shown in FIG. 1, the blank which is molded comprises substantially identical parts 11*a*, 11*b*. Each of the parts comprises a semi-cylindrical socket forming portion 12*a*, 12*b* which includes a transverse wall 13*a*, 13*b*, an intermediate flexible portion 14*a*, 14*b*, and a base forming portion 15*a*, 15*b*. The intermediate portions 14*a*, 14*b* are generally semi-circular in transverse cross section and sinuous or corrugated in longitudinal cross section and are sufficiently thin so that they are flexible to provide the desired shock resistance. The parts 11*a*, 11*b* are joined by integral hinges 16, 17, 18 so that when the parts 11*a*, 11*b* are brought into abutting relationship, the socket forming portions 12*a*, 12*b* will define a socket for receiving a bulb or lamp, the flexible portions 14*a*, 14*b* will form a generally cylindrical shock resistant mounting while the base portions 15*a*, 15*b* will form a base.

Part 11*a* is formed with projections 19, 20 that are adapted to extend into frictional engagement with openings 21, 22, respectively in part 11*b* to hold the parts in assembled relation. When the parts are swung into assembled relation, the openings 23 in the base are in position for supporting the lamp support on the vehicle by means of screws. Semi-circular grooves 24, 25 cooperate when the base portions are brought into engagement to define an additional opening for a mounting screw.

The socket forming portions 12*a*, 12*b* are formed with bayonet openings 26, 27 for receiving the prongs of a bulb. An electrical connection 28 is formed by a contact in the wall of portion 12*b*.

The other electrical connection to the bulb is formed by an insulating disc 29 that supports a contact 30 in the base of the socket with a wire 31 extending through openings 32, 33 in the base wall 13*a* and base to complete the circuit. A spring 34 yieldingly urges the disc 29 upwardly and, in turn, the contact 30 against the bulb.

It can thus be seen that there has been provided a simple and inexpensive support for the bulb which through the intermediate portions 14*a*, 14*b* provides shock resistance in a plurality of directions so that the support can be used in various environments with the bulb vertically, horizontally or at other angles. The support involves a minimum number of parts and is easily assembled and mounted in position.

Figure 2:
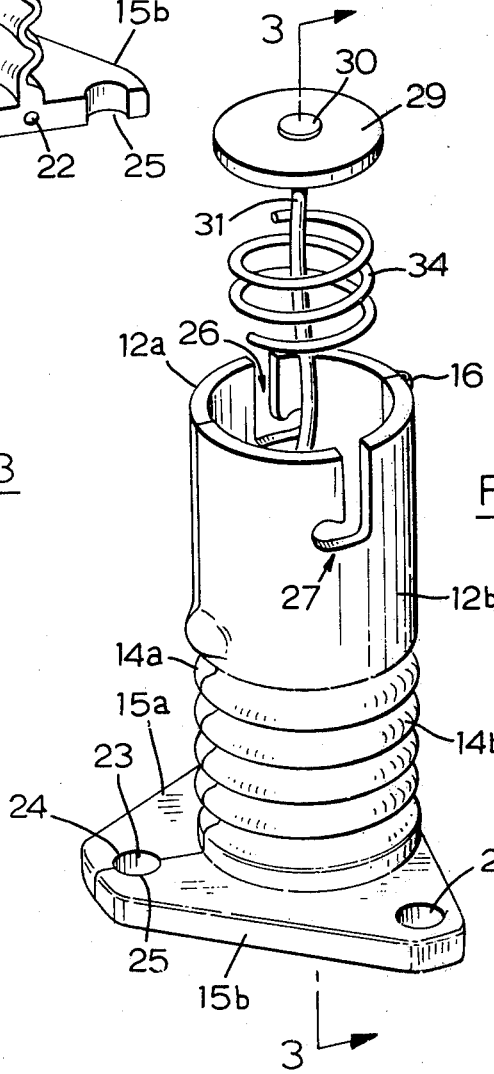
FIG. 2 is an exploded perspective view of the lamp assembly embodying the invention.
Figure 3:
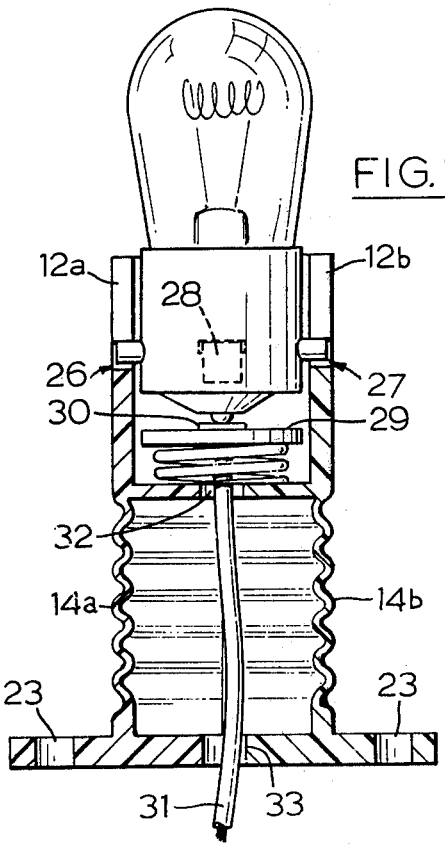
FIG. 3 is a vertical sectional view of the assembly embodying the invention.
Figure 4:
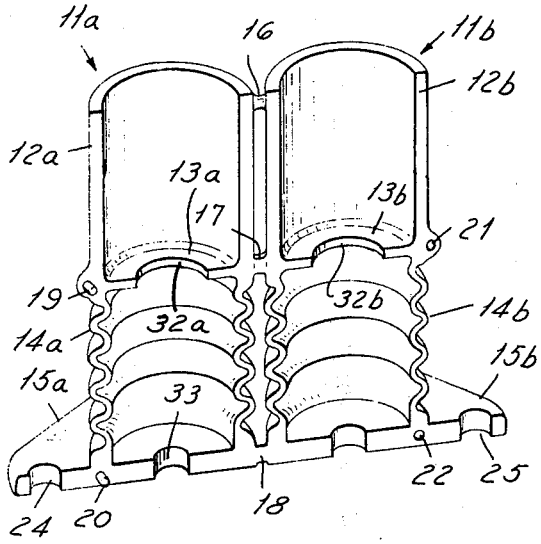
FIG. 4 is a perspective view of a modified form of lamp support before assembly.
Figure 5:
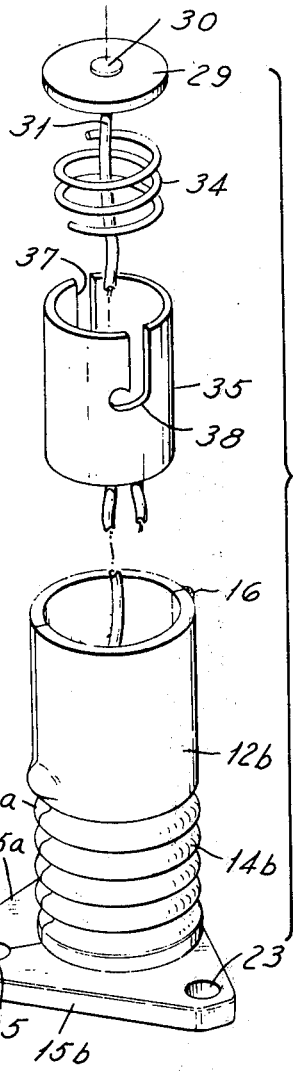
FIG. 5 is an exploded perspective view of a lamp assembly embodying the invention.
Figure 6:
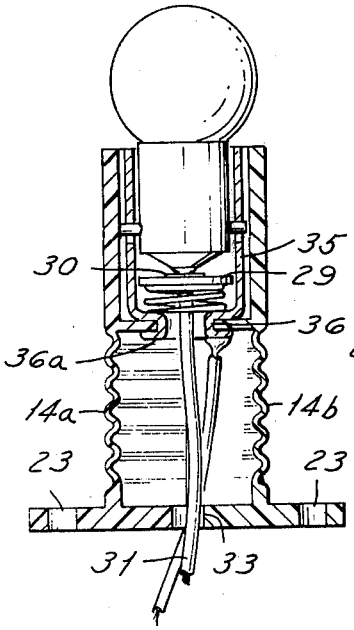
FIG. 6 is a vertical sectional view of the assembly shown in FIG. 5.

In the form of the invention shown in FIGS. 4–6, the opening 32*a* in the molded blank is made larger than in the form shown in FIGS. 1–3, the openings 26, 27 and electrical connection are eliminated. The interengagement with the bulb is provided by an insert 35 made of conductive material such as copper which is tubular and has a reduced diameter portion 36 which extends through opening 32*a* and is crimped over as at 36*a* to hold the insert on the transverse wall. Insert 35 is formed with bayonet openings 37, 38 for receiving the prongs of a bulb. All the other parts of the assembly are identical to the form of the invention shown in FIGS. 1–3 and for purposes of clarity have been given identical reference numerals.

Figure 7:
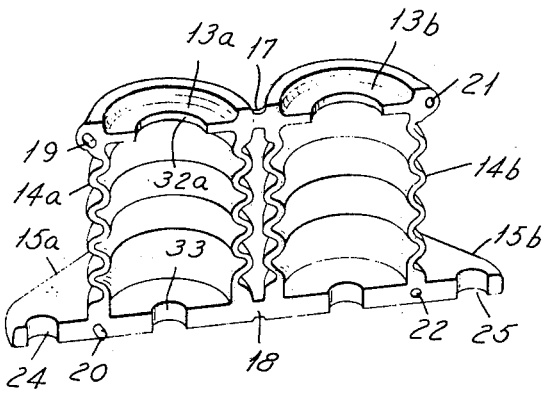
FIG. 7 is a perspective view of a further modified form of lamp support before assembly.
Figure 8:
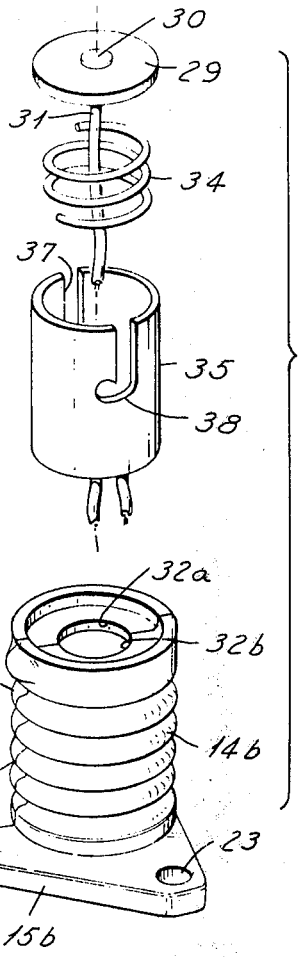
FIG. 8 is an exploded perspective view of a lamp assembly embodying the invention.
Figure 9:
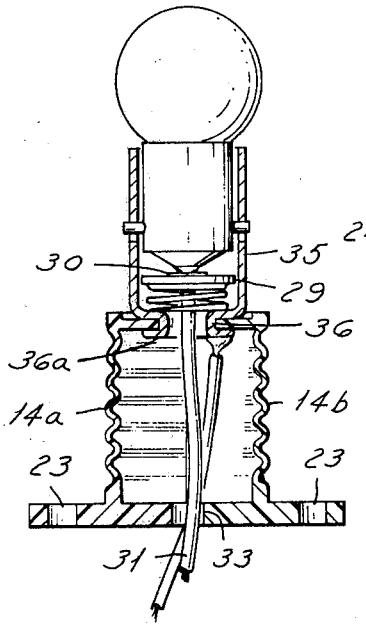
FIG. 9 is a vertical sectional view of the assembly shown in FIG. 8.

In the form of the invention shown in FIGS. 7–9, the assembly is identical to that shown in FIGS. 4–6 except that the portions 12*a*, 12*b* are eliminated leaving insert unsurrounded and supported by the transverse wall.

I claim:

1. In a shock resistant lamp support, the combination comprising two plastic parts, each of said parts comprising an upper semi-cylindrical socket forming portion, an intermediate integral flexible portion extending from said socket forming portion, said flexible portion having at least a part thereof of thin cross section to provide an area of flexibility, and an integral lower thickened base portion, integral hinge means between said two parts whereby said parts can be brought into abutting relation to define a cylindrical socket, said intermediate flexible portion extending between said socket forming portion and said base portion, a transverse wall in each said socket forming portion separating said socket forming portion from said intermediate portion.

2. In a shock resistant lamp support, the combination comprising two plastic parts, each of said parts comprising an upper semi-cylindrical socket forming portion.

an intermediate integral flexible portion extending from said socket forming portion, said flexible portion having at least a part thereof of thin cross section to provide an area of flexibility, and an integral lower thickened base portion, integral hinge means between said two parts whereby said parts can be brought into abutting relation to define a cylindrical socket, said intermediate flexible portion, extending between said socket forming portion and said base portion, interengaging means between said two parts for holding said two parts in assembled relation, said last-mentioned means comprising projections on one of said parts and openings in the other of said parts into which said projections extend and are frictionally held.

3. The combination set forth in claim 2 wherein said projections and said openings are provided on said base portion and socket forming portion.

4. In a shock resistant lamp support, the combination comprising two plastic parts, each of said parts comprising an upper semi-cylindrical socket forming portion, an intermediate integral flexible portion extending from said socket forming portion, said flexible portion having at least a part thereof of thin cross section to provide an area of flexibility, and an integral lower thickened base portion, integral hinge means between said two parts whereby said parts can be brought into abutting relation to define a cylindrical socket.

said intermediate flexible portion extending between said socket forming portion and said base portion, said intermediate flexible portion in each said part being generally semi-circular in transverse cross section and corrugated in longitudinal cross section.

5. In a shock resistant lamp support, the combination comprising two plastic parts, each of said parts comprising an upper semi-cylindrical socket forming portion, an intermediate integral flexible portion extending from said socket forming portion, said flexible portion having a thin cross section to provide an area of flexibility, said intermediate flexible portion in each said part being generally semi-circular in transverse cross section and corrugated in longitudinal cross section, and an integral lower thickened base portion, integral hinge means between said two parts whereby said parts can be brought into abutting relation to define a cylindrical socket, said intermediate flexible portion extending between said socket forming portion and said base portion, interengaging means between said two parts for holding said two parts in assembled relation.

6. The combination set forth in claim 5 including a transverse wall in each said socket forming portion separating said socket forming portion from said intermediate portion.

7. In a shock resistant lamp support, the combination comprising a plastic lamp receiving socket portion having interengaging means thereon for receiving and holding a bulb in position, an integral flexible portion extending from said socket portion, said integral flexible portion having a sufficiently thin cross section to provide relative resiliency with respect to said socket portion, and an integral base portion having a relatively rigid cross section connected to said flexible portion, said flexible portion comprising the sole connection between said socket portion and said base portion.

8. The combination set forth in claim 7 wherein said flexible portion is generally semicircular in transverse cross section.

9. The combination set forth in claim 7 wherein electrical connection means are provided for said bulb in said socket portion.

10. In a shock resistant lamp support, the combination comprising two plastic parts, each of said parts comprising an upper semi-cylindrical socket forming portion, an intermediate integral flexible portion extendng from said socket forming portion, said flexible portion having at extending a part thereof of thin cross section to provide an area of flexibility, and an integral lower thickened base portion, integral hinge means between said two parts whereby said parts can be brought into abutting relation to define a cylindrical socket, said intermediate flexible portion extending between said socket forming portion and said base portion, said flexible portion comprising the sole connection between said socket forming portion and said base portion.

11. The combination set forth in claim 10 including a transverse wall portion in each said socket portion separating said socket forming portion from said intermediate portion.

12. The combination set forth in claim 11 including an insert supported by said transverse wall portion and having means thereon for supporting a bulb.

13. The combination set forth in claim 12 including interengaging means between said two parts for holding said two parts in assembled relation, said last-mentioned means comprising projections on one of said parts and openings in the other of said parts into which said projections extend and are frictionally held.

14. The combination set forth in claim 11 wherein said intermediate flexible portion in each said part is generally semi-circular in transverse cross section and corrugated in longitudinal cross section.

15. In a shock resistant lamp support, the combination comprising two plastic parts, each of said parts comprising a transverse wall portion, an intermediate integral flexible portion extending from said wall portion, said flexible portion having at least a part thereof of thin cross section to provide an area of flexibility, and an integral lower thickened base portion, integral hinge means between said two parts whereby said parts can be brought into abutting relation, said intermediate flexible portion extending between said transverse wall portion and said base portion, and an insert mounted on said transverse wall portion and having means thereon for supporting a bulb.

16. The combination set forth in claim 15 including interengaging means between said two parts for holding said two parts in assembled relation, said last-mentioned means comprising projections on one of said parts and openings in the other of said parts into which said projections extend and are frictionally held.

17. In a shock resistant lamp support, the combination comprising a plastic lamp receiving socket portion having interengaging means thereon for receiving and holding a bulb in position, an integral flexible portion extending from said socket forming portion, said integral flexible portion having a sufficiently thin cross section to provide relative resiliency with respect to said socket forming portion, and an integral base portion having a relatively rigid cross section connected to said flexible portion, said flexible portion comprising the sole connection between said socket forming portion and said base portion, said flexible portion comprising an undulating cross section between said socket portion and said base portion.

* * * * *